US005499503A

United States Patent [19]

Stoychoff

[11] Patent Number: 5,499,503

[45] Date of Patent: Mar. 19, 1996

[54] HYDRAULIC SWING CIRCUIT

[75] Inventor: Terry A. Stoychoff, Garner, Iowa

[73] Assignee: Iowa Mold Tooling Company, Inc., Garner, Iowa

[21] Appl. No.: 310,568

[22] Filed: Sep. 22, 1994

[51] Int. Cl.$^6$ ..... F16D 31/02; F15B 11/08

[52] U.S. Cl. ..... 60/469; 60/493; 60/494; 91/445

[58] Field of Search ..... 91/444, 445, 446; 60/369, 468, 460, 464, 466, 494, 493, 469

[56] References Cited

U.S. PATENT DOCUMENTS

| | | | |
|---|---|---|---|
| 3,943,824 | 3/1976 | Fletcher . | |
| 3,954,046 | 5/1976 | Stillhard . | |
| 3,972,537 | 8/1976 | McClelland . | |
| 3,972,557 | 8/1976 | Hudston et al. . | |
| 3,986,437 | 10/1976 | Lioux . | |
| 3,988,969 | 11/1976 | Lioux . | |
| 4,425,759 | 1/1984 | Krusche | 60/460 X |
| 4,505,339 | 3/1985 | Kramer et al. . | |
| 4,716,729 | 1/1988 | Kakeya . | |
| 5,018,935 | 5/1991 | Gage . | |
| 5,063,742 | 11/1991 | Yoshimatsu | 60/468 X |
| 5,101,630 | 4/1992 | Wagenseil | 60/460 |
| 5,191,826 | 3/1993 | Brunner . | |
| 5,211,196 | 5/1993 | Schwelm | 91/446 X |
| 5,325,761 | 7/1994 | Schwing | 60/494 X |

*Primary Examiner*—Edward K. Look

*Assistant Examiner*—Hoang Nguyen

*Attorney, Agent, or Firm*—Wood, Phillips, VanSanten, Clark & Mortimer

[57] ABSTRACT

Roughness or jerkiness in a hydraulic swing circuit in an implement having a plurality of control circuits each having a work performing device (28), (30), (32) including a swing circuit having a hydraulic motor (32), which when under an aiding load may function as a pump, is avoided in a construction that includes a source (10) of hydraulic fluid under pressure and a plurality of control valves (22), (24), (26) for the circuits which are interconnected between the source (10) and the associated work performing device (28), (30), (32). The system includes a pair of hydraulic conduits (34), (36) extending from the control valve (26) for the swing circuit to the hydraulic motor (32). A pair of pilot operated, dual level pressure relief valves (56), (58) are connected oppositely across the conduits (34), (36) at a location between the control valve (26) for the swing circuit and the hydraulic motor (32). A pair of pilot operated check valves (48), (50) are provided, one in each of the conduits (34), (36) at a location between the control valve (26) for the swing circuit and the pressure relief valves (56), (58). Each of the check valves (48) and (50) is oriented in its associated conduit to allow flow from the control valve (26) for the swing circuit toward the hydraulic motor (32) but not the reverse except when receiving a pilot signal. The pilots (60), (62) of the relief valves are connected to the conduit (34), (36) whose pressure is relieved by the associated pressure relief valve (56), (58) and the pilots (52), (54) for each of the check valves (48), (50) are connected to the conduit (34), (36) in which the other check valve (48), (50) is located.

5 Claims, 1 Drawing Sheet

HYDRAULIC SWING CIRCUIT

FIELD OF THE INVENTION

This invention relates to hydraulic circuits, and more particularly, to a swing circuit such as is used in crane type devices such as log loaders or in excavators such as back hoes.

BACKGROUND OF THE INVENTION

Many types of work performing apparatus include booms or arms that are pivotal about an axis so as to be readily maneuverable to a desired location. Motors are utilized to pivot the boom about such axis and in a large number of cases, the motors employed are hydraulic motors. The circuit used to control the operation of such motors is referred to as the "swing circuit" because it operates to cause the boom to swing about the aforementioned axis.

In the usual case, the swing circuit receives hydraulic fluid under pressure from a hydraulic pump. Typically, other hydraulic circuits are also powered by the same pump. Such circuits may include a circuit for controlling a grapple or a bucket, a circuit for controlling the relation of an outer boom to an inner boom in a two part boom construction, etc.

In operation of such devices, a performance drawback is in the swing circuit. Typically, many of these types of apparatus have a swing system whose operation is extremely rough and jerky. This unevenness in operation is particularly apparent during a deceleration or aiding load situation.

If one considers the apparatus boom when it is initially stationary, and applies hydraulic fluid under pressure is applied to the swing motor to cause boom movement, the boom will begin to accelerate as it moves to a new position. As the new position is approached, the operator will halt the flow of hydraulic fluid to the motor to halt the boom. However, because the boom has mass and is moving, it contains a sizable quantity of kinetic energy due to inertia of the moving components.

Consequently, as hydraulic fluid is shut off to the hydraulic motor, the inertia in the system causes the boom to tend to continue to swing, resulting in a so-called aiding load situation which continues until the boom is fully decelerated to a halt. This, in turn, causes the hydraulic motor to function as a pump during the deceleration procedure.

If the hydraulic fluid now being pumped by the hydraulic motor is blocked, extremely high loadings on system components result. In some systems, the torque in the swing system upon deceleration can be as much as twice the torque during acceleration. As a consequence, all of the components of the swing system must be sized for the high deceleration torque which increases both component size and cost.

To avoid these problems, a variety of systems have been devised. In a very simple system, torque reliefs are located in the control valves to provide hydraulic braking as well as to protect the hydraulic motor during deceleration.

Most of these systems have met with some success. However, because swing systems are bi-rotational, that is, used to rotate a boom or the like in both directions around a pivot point, acceleration and deceleration pressures must be the same, and this necessitates "over building" to accommodate the high deceleration torque.

To overcome this difficulty, it has been proposed to use two stage dual level cross-over relief valves. This arrangement employs pilot operated pressure relief valves that are cross-connected across the swing motor. These valves are such that when they receive a pilot signal, they will open as pressure relief valves only at a relatively high pressure, whereas when no pilot signal is present, they will operate and open as pressure relief valves at a relatively low pressure.

These systems require a controller to select the pilot pressure to achieve the desired result and as a consequence, the expense of providing a controller is not conducive to a number of types of smaller, less expensive apparatus of the type having swing circuits.

As still another alternative, dual hydraulic circuits have been employed including one pump used solely for the purpose of providing hydraulic fluid to the swing circuit and another pump used for providing hydraulic fluid to all other circuits. This system has the advantage of preventing pressure fluctuations that occur as other circuits are operated from affecting control parameters in the swing circuit. However, such a system has the disadvantage of requiring an extra pump, extra lines, extra valves, etc. The ultimate result is added product cost.

Still other systems utilizing cross-connected two stage dual cross-over relief valves may utilize a manually operated control valve to control pilot pressure. For example, a foot operated valve might be utilized. While such systems are operative, they have the disadvantage of requiring additional hydraulic lines as well as excessive manual control effort.

The present invention is directed to overcoming one or more of the above problems.

SUMMARY OF THE INVENTION

It is the principal object of the invention to provide a new and improved hydraulic swing circuit. More specifically, it is an object of the invention to provide a hydraulic swing circuit whose operation is smooth and which is of an inexpensive construction.

An exemplary embodiment of the invention achieves the foregoing object in a hydraulic system including a swing circuit having a hydraulic motor which, when under an aiding load, may function as a pump, along with a source of hydraulic fluid under pressure. A control valve is interconnected between the source and the hydraulic motor. The invention contemplates the provision of a pair of hydraulic conduits extending from the control valve to the hydraulic motor. A pair of pilot operated relief valves are connected oppositely across the conduits. A pair of pilot operated control valves are provided, one in each of the conduits, at a location between the control valve and the relief valves. The pilots of the relief valves are connected to the conduit whose pressure is relieved by the associated relief valve at a location between the relief valve and the control valve while the pilot of each check valve is connected to the conduit in which the other check valve is located at a location between the check valve and the control valve. Each check valve is oriented in the associated conduit to allow flow from the control valve toward the hydraulic motor, but not the reverse, except when receiving a pilot signal.

As a consequence of this construction, upon deceleration, when the motor begins to act as a pump rather than a motor, the resultant lowering of pressure allows one of the relief valves to recirculate fluid back to the opposite side of the motor to provide at low pressure levels for smooth deceleration.

In a highly preferred embodiment, the relief valves are dual level pressure relief valves which operate to relieve pressure at a high value when receiving a pilot signal and operate to relieve pressure at a relatively low pressure value when no pilot signal is being received.

In a highly preferred embodiment, the hydraulic system includes a plurality of control circuits, each having a work performing device, and a plurality of control valves, at least one for each circuit.

In one embodiment of the invention, the pressure relief valves and the check valves are disposed in a single valve body.

In a highly preferred embodiment of the invention, there is additionally included a pair of additional check valves and a sump port within the valve body. Each of the additional check valves is connected between an associated one of the conduits and the port and is oriented to allow flow from the port to the associated conduit, but not the reverse.

Other objects and advantages will become apparent from the following specification taken in connection with the accompanying drawings.

DESCRIPTION OF THE PREFERRED EMBODIMENTS

Figure 1:
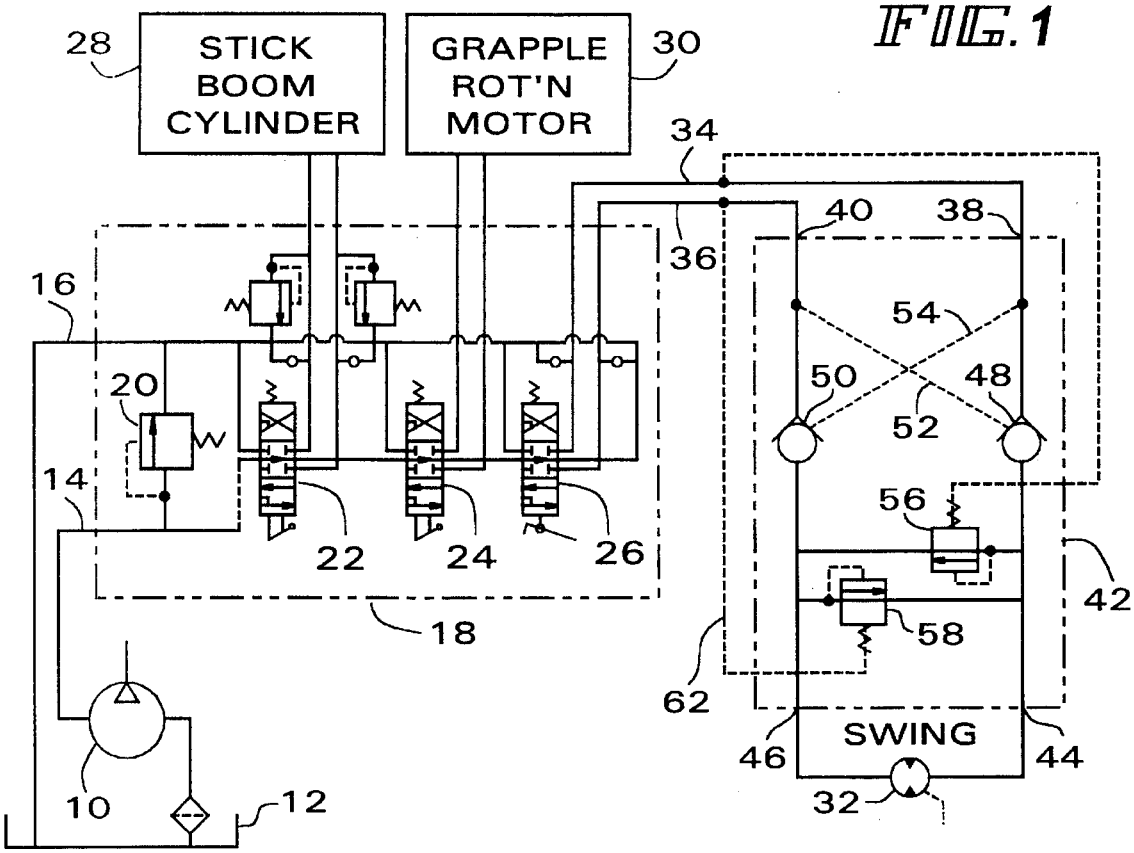
FIG. 1 is a schematic of a hydraulic system, including a hydraulic swing system made according to the invention.

An exemplary embodiment of the invention is illustrated in the drawings and will be described in the environment of a log loader. However, it is to be understood that the invention in not restricted to use in log loader apparatus that may be utilized in any type of loader or excavator or other type of apparatus having a swing circuit.

The hydraulic system includes a hydraulic pump 10 which may be driven by any suitable prime mover (not shown). The pump 10 is connected to a sump 12 for receipt of make-up hydraulic fluid and provides high pressure hydraulic fluid on a supply line 14. A return line 16 extends to the sump.

The lines 14 and 16 extend to a control valve block 18 which may include an internal pressure relief valve 20 connected across the lines 14 and 16 and operative to dump high pressure fluid to the sump line 16 in the event a predetermined pressure level is exceeded.

Within the control valve block 18 are several control valves. In the embodiment illustrated there are three control valves including a stick boom control valve 22, a grapple rotation motor control valve 24, and a swing circuit control valve 26. These valves are all basically conventional and are manually operated as is well known. Each is a four-way valve and the valve 22 is connected to a work performing device such as the stick boom cylinder 28 of a log loader. Such a stick boom cylinder 28 will typically be a double acting cylinder as is well known.

The valve 24 is connected to a grapple rotation motor 30. The motor 30 is operative to rotate the log lifting grapple as is well known.

The valve 26 is connected to the swing circuit which includes a bi-directional, hydraulic motor 32 which is connected in a conventional fashion to pivot the boom of the log loader about a generally vertical axis.

To this end, a first conduit 34 extends from the valve 26 to one side of the motor 32 while a second conduit 36 extends from the valve 26 to the opposite side of the motor. As is well known, depending upon the position of the valve 26, the conditions at the conduits 34 and 36 may be altered. For example, when the valve 26 is centered, both of the conduits 34 and 36 will be blocked while if the valve 26 is shifted to the right or top as viewed in FIG. 1, pressurized fluid will be directed to the conduit 36 while the conduit 34 is connected to the sump 12 to cause the swing motor 32 to rotate in one direction. Alternatively, if the valve 26 is shifted downwardly or to the left from the position shown in FIG. 1, line 34 will be connected to the high pressure line 14 and the conduit 36 connected to the sump 12.

The conduits 34 and 36 extend to ports 38 and 40 in a valve body, shown schematically at 42. The swing motor 32 is connected to ports 44 and 46 in the valve body 42. The ports 38 and 44 are connected together across a pilot operated check valve 48 within the body while the ports 40 and 46 are similarly connected across a pilot operated check valve 50. It will be noted that the pilot line 52 for the check valve 48 is connected to the port 40 whereas the pilot 54 for the check valve 50 is connected to the port 38. In essence, this means that the pilots 52 and 54 are connected to the downstream side of the valve 26, i.e., connected to the conduits 34 and 36 at a location between the motor 32 and the control valve 26.

Cross-connecting the ports 44 and 46 are oppositely connected, dual level, pressure relief valves 56 and 58, both of which are pilot operated. The pressure relief valve 56 is constructed to relieve pressure ultimately from the line 34 while the pressure relief valve 58 is located so as to relieve pressure in the line 36.

As noted, both pressure relief valves 56 and 58 are dual level pressure relief valves. That is to say, when each receives an appropriate pilot signal, it will only relieve relatively high levels of pressure in the direction mentioned previously. Conversely, when no pilot signal is present, valves 56 and 58 are operative to relieve pressure at much lower pressure levels.

The pilot 60 for the pressure relief valve 56 is connected to the conduit for which the valve 56 is operative to relieve pressure, that is, the conduit 34. Similarly, the pilot 62 of the pressure relief valve 58 is connected to the line for which the valve 58 is operative to relieve pressure, that is, the conduit 36.

It will be observed that in both cases, the connection of the pilots 60 and 62 to the conduits 34 and 36 is upstream of the check valves 48 and 50 and downstream of the control valve 26.

Operation is generally as follows.

If the control valve 26 is operated to provide pressure fluid to the line 34, the line 36 will be connected to the sump. High pressure fluid will flow into the port 38, through the check valve 48 and to the swing motor 32. The load on the swing motor will resist movement of the output of the latter and that in turn will result in a pressure rise on the line 34. This pressure rise will accomplish two things. For one, it will cause the pressure relief valve 56 to receive a pilot signal such that the same will only relieve pressure at a high pressure level. As a consequence, hydraulic fluid at high pressure is available to operate the swing motor 32 as is desired.

Simultaneously, high pressure in the line 34 will be directed via the pilot 54 to cause check valve 50 to open, allowing spent hydraulic fluid to flow to the sump 12. At this time, the pressure relief valve 58 will not be receiving a pilot signal because the line 36 is effectively connected to sump. As a result, the pressure relief valve 58 will be in it's low pressure setting and quite obviously, will not discharge fluid from the line 36 to the high pressure side of the system.

As a consequence, the high pressure hydraulic fluid will cause the swing motor 32 to operate in one direction of rotation.

When it is desired to halt the rotation of the swing motor 32, the operator will manually change the position of the valve 26. This will result in the cut-off of high pressure hydraulic fluid from the pump 10 to the conduit 34. At the same time, however, the load being operated by the swing motor, due to inertial effect, will continue to move and create a so-called aiding load situation which will cause the swing motor 32 to operate as a pump.

Operation of the swing motor 32 as a pump will cause the same to seek make-up fluid from the port 44. This will result in a lowering of the pressure in the line 34. As a consequence, the pilot signal on the pilot 54 for the check valve 50 will be removed causing the latter to close. The pressure relief valve 58 will already be at it's low pressure setting and as a consequence, hydraulic fluid being pumped by the swing motor 32 to the port 36 may be directed to the port 44 through the pressure relief valve 58. Such direction of hydraulic fluid will continue until the inertial energy driving the swing motor 32 is sufficiently low that the pressure at the port 46 falls below the low pressure setting of the pressure relief valve 58. At this time the system closes up and all motion ceases.

The identical, but opposite action occurs if pressurized fluid is directed to the line 36 rather than the line 34.

In either event, it will be appreciated that high pressure hydraulic fluid is available to accelerate the swing motor 32 and maintain it's operation while only relatively low pressure fluid levels are present during deceleration or aiding load conditions because of the ability to use the dual limit pressure relief valves 56 and 58. At the same time, the system allows them to operate independently of other occurrences during deceleration by reason of the provision of the check valves 48 and 50 so as to avoid jerkiness that might be caused in other systems as a result of simultaneous operation of either the stick boom cylinder 28 or the grapple rotation motor 30.

Figure 2:
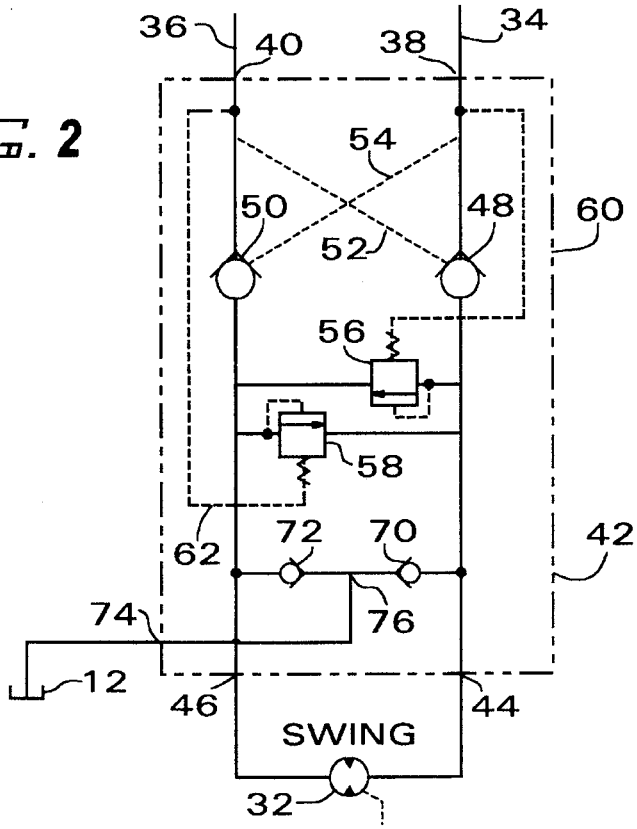
FIG. 2 is a somewhat schematic view of a modified embodiment of a valve construction employed in the invention.

FIG. 2 shows a slightly modified embodiment of the valve body 42. In this embodiment, the pilots 60 and 62 for the pressure relief valves 56 and 58 are wholly contained within the body 42 and connect to the ports 38 and 40, respectively, upstream of the check valves 48 and 50.

In addition, additional check valves 70 and 72 may be disposed with in the valve body 42. The valve body 42 is provided with a port 74 which is adapted to be connected to the sump 12 as illustrated.

The port 74 is connected to a common junction 76 of the check valves 70 and 72 which in turn are respectively connected to the ports 44 and 46. The arrangement is such that the additional check valves 70 and 72 will allow fluid to flow from the port 74, and thus the sump 12, through the valve 70 to the port 44, or through the valve 72 to the port 46 in the event pressure on either side of the swing motor 32 becomes lower than the sump pressure. As can be appreciated, in an aiding load situation, if makeup fluid is not provided sufficiently rapidly to the low pressure side of the swing motor 32, cavitation may occur. The check valves 70 and 72, together with the port 74 and its connection to the sump 12 provide a means of avoiding such cavitation.

From the foregoing, it will be appreciated that a hydraulic swing circuit made according to the invention eliminates the roughness found in many prior art systems while at the same time accomplishes that object at a minimum of expense. Duplication of pumps and/or piping, and/or valves is completely avoided as is any need for sophisticated controllers.

I claim:

1. In a hydraulic system including a swing circuit having a hydraulic motor which, when under an aiding load, may function as a pump; a source of hydraulic fluid under pressure; a control valve interconnected between said source and said hydraulic motor; the combination of:

a pair of hydraulic conduits extending from the control valve to said hydraulic motor;

a pair of pilot operated relief valves connected oppositely across said conduits; and a pair of pilot operated check valves, one in each of said conduits at a location between said control valve and said relief valves, each said check valve being oriented in the associated conduit to allow flow from said control valve for said swing circuit toward said hydraulic motor, but not the reverse, except when receiving a pilot signal;

the pilots of said relief valves being connected to the conduit whose pressure is relieved by the associated relief valve at a location between said relief valves and said control valve; and the pilot of each said check valve being connected to the conduit in which the other check valve is located at a location between said check valves and said control valve.

2. In a hydraulic system including a swing circuit having a hydraulic motor which, when under an aiding load, may function as a pump, a source of hydraulic fluid under pressure; a control valve interconnected between said source and said hydraulic motor, the combination of a pair of hydraulic conduits extending from the control valve to said hydraulic motor;

a pair of pilot operated dual level pressure relief valves connected oppositely across said conduits; and a pair of pilot operated check valves, one in each of said conduits at a location between said control valve and said pressure relief valves, each said check valve being oriented in its associated conduit to allow flow from said control valve toward said hydraulic motor but not the reverse except when receiving a pilot signal;

the pilots of said pressure relief valves being connected to the conduit whose pressure is relieved by the associated pressure relief valve; and the pilot of each said check valve being connected to the conduit in which the other check valve is located at a location between said check valves and said control valve.

3. In a hydraulic system for an implement having a plurality of control circuits each having a work performing device and including a swing circuit having a hydraulic motor which, when under an aiding load, may function as a pump; a source of hydraulic fluid under pressure; a plurality of control valves, at least one for each circuit and interconnected between said source and the associated work performing device; the combination of:

a pair of hydraulic conduits extending from the control valve for said swing circuit to said hydraulic motor;

a pair of pilot operated dual level pressure relief valves connected oppositely across said conduits at a location between said control valve for said swing circuit and said hydraulic motor; and a pair of pilot operated check valves, one in each of said conduits at a location between said control valve for said swing circuit and said pressure relief valves, said check valves being oriented in the associated conduit to allow flow from said control valve for said swing circuit toward said hydraulic motor, but not the reverse, except when receiving a pilot signal;

the pilots of said pressure relief valves being connected to the conduit whose pressure is relieved by the associated pressure relief valve at a location between said pressure relief valves and said control valve for said swing circuit; and the pilot of each said check valve being connected to the conduit in which the other check valve is located at a location between said check valves and said control valve for said swing circuit.

4. The hydraulic system of claim 3 wherein said pressure relief valves and said check valves are disposed in a single valve body.

5. The hydraulic system of claim 4 further including a pair of additional check valves and a sump port in said body, each said additional check valve being connected between an associated one of said conduits and said port and oriented to allow flow from said port to the associated conduit but not the reverse.

* * * * *